US009756695B2

(12) United States Patent
Uenoyama et al.

(10) Patent No.: US 9,756,695 B2
(45) Date of Patent: Sep. 5, 2017

(54) LIGHTING DEVICE CAPABLE OF CHANGING A COLOR OF ILLUMINATION LIGHT AND LIGHTING FIXTURE

(71) Applicant: Panasonic Intellectual Property Management Co., Ltd., Osaka (JP)

(72) Inventors: Koji Uenoyama, Kyoto (JP); Koji Watanabe, Kyoto (JP); Hiroyuki Matsumoto, Hyogo (JP); Shinichi Murakami, Osaka (JP); Yuichirou Hirowatari, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/178,825

(22) Filed: Jun. 10, 2016

(65) Prior Publication Data

US 2016/0374160 A1 Dec. 22, 2016

(30) Foreign Application Priority Data

Jun. 19, 2015 (JP) ..... 2015-123950

(51) Int. Cl.
*H05B 33/08* (2006.01)
*F21V 29/76* (2015.01)
(Continued)

(52) U.S. Cl.
CPC ..... *H05B 33/086* (2013.01); *F21V 7/0083* (2013.01); *F21V 14/02* (2013.01);
(Continued)

(58) Field of Classification Search
CPC ... H05B 33/086; F21V 29/763; F21V 7/0083; F21V 14/02; F21V 23/02
(Continued)

(56) References Cited

U.S. PATENT DOCUMENTS 7,626,345 B2 * 12/2009 Young ..... H05B 33/0866 315/291
8,363,069 B2 * 1/2013 Aldrich ..... G01J 3/46 345/690
(Continued)

FOREIGN PATENT DOCUMENTS

JP 2001-184910 A 7/2001
JP 2004-213986 A 7/2004
(Continued)

*Primary Examiner* — Dylan White
(74) *Attorney, Agent, or Firm* — Renner Otto Boisselle & Sklar, LLP

(57) ABSTRACT

The lighting device includes a controller for determining first, second, and third desired values of first, second, third drive currents to first, second, and third light sources, based on a correction coefficient for correcting chromaticity points of the first, second, and third light sources to first, second, and third chromaticity points. The first, second, and third light sources have first, second, and third ranges of individual differences in color. The first chromaticity point is an intersection of a straight line touching the first and second ranges and another straight line touching the first and third ranges. The second chromaticity point is an intersection of a straight line touching the second and first ranges and another straight line touching the second and third ranges. The third chromaticity point is an intersection of a straight line touching the third and first ranges and another straight line touching the third and second ranges.

6 Claims, 8 Drawing Sheets

(51) Int. Cl.

| | |
|---|---|
| ***F21V 7/00*** | (2006.01) |
| ***F21V 14/02*** | (2006.01) |
| ***F21V 23/02*** | (2006.01) |
| ***F21Y 101/00*** | (2016.01) |
| *F21Y 101/02* | (2006.01) |

(52) U.S. Cl.
CPC ..... *F21V 23/02* (2013.01); *F21V 29/763* (2015.01); *F21Y 2101/02* (2013.01)

(58) Field of Classification Search
USPC ..... 315/297
See application file for complete search history.

(56) References Cited

U.S. PATENT DOCUMENTS 8,427,721 B2 * 4/2013 Vinkenvleugel ..... H05B 33/086 315/291
8,783,887 B2 * 7/2014 Caruso ..... F21V 9/10 313/467
8,928,249 B2 * 1/2015 Raj ..... H05B 33/0863 315/153
9,167,656 B2 * 10/2015 Raj ..... H05B 33/0869
2004/0105261 A1 * 6/2004 Ducharme ..... H05B 33/0857 362/231
2006/0049782 A1 * 3/2006 Vornsand ..... H05B 33/0869 315/312
2009/0296384 A1 * 12/2009 Van De Ven ..... H05B 33/0803 362/231
2012/0001555 A1 * 1/2012 Tu ..... F21V 7/0008 315/161
2012/0104953 A1 * 5/2012 Chobot ..... H05B 33/0872 315/153
2012/0300450 A1 * 11/2012 Yamamoto ..... F21V 23/005 362/231
2013/0049602 A1 * 2/2013 Raj ..... H05B 33/0869 315/151
2015/0029713 A1 * 1/2015 Fieberg ..... H05B 33/0857 362/231
2015/0173151 A1 * 6/2015 Ter Weeme ..... H05B 33/0863 315/294
2015/0268408 A1 * 9/2015 Ohta ..... G02F 1/133609 349/65

FOREIGN PATENT DOCUMENTS

JP 2006-147171 A 6/2006
JP 2012-248554 A 12/2012

* cited by examiner

LIGHTING DEVICE CAPABLE OF CHANGING A COLOR OF ILLUMINATION LIGHT AND LIGHTING FIXTURE

CROSS-REFERENCE TO RELATED APPLICATION

The present application is based upon and claims the benefit of a priority of Japanese Patent Application No. 2015-123950, filed on Jun. 19, 2015, the entire contents of which are incorporated herein by reference.

TECHNICAL FIELD

The present disclosure relates to lighting devices and lighting fixtures, and in particular to a lighting device capable of changing a color of illumination light and a lighting fixture including the lighting device.

BACKGROUND ART

Document 1 (JP 2012-248554 A) discloses a variable color light emitting device and a lighting fixture including the same. The variable color light emitting device disclosed in Document 1 includes three types of light sources including a blue light source, a red light source, and a green light source and being different in chromaticity of emitted light, and a driver for varying light outputs from the light sources. The red light source and the green light source are selected so that a ratio of a distance from chromaticity of a desired color temperature on the black body locus to reference chromaticity of the red light source to a distance from the chromaticity of the desired color temperature to reference chromaticity of the green light source is constant. The reference chromaticity of each of the red light source and the green light source is set as a reference of chromaticity. With regard to the light sources selected as above, even if the light sources have chromaticity different from the reference chromaticity, such light sources can still vary chromaticity of mixed light from the three types of light sources in a similar manner to the light sources having reference chromaticity. Therefore, Document 1 offers suppression of an individual difference in chromaticity of mixed light independent from feedback control or the like.

The variable color light emitting device disclosed in Document 1 aims to adjust the color temperature of emitted light (the illumination light) within a predetermined range according to the black body locus (e.g., the range of 2000 K to 5000 K). However, some applications such as stage illumination may require illumination light having chromaticity not according to the black body locus. The variable color light emitting device disclosed in Document 1 is not suitable for sufficiently suppressing differences in color of illumination light between multiple lighting devices.

SUMMARY

An objective of the present disclosure is to expand a range of available colors, and suppress an undesired effect due to an individual difference in color of illumination light.

The lighting device of one aspect according to the present disclosure includes a first light source, a second light source, a third light source, a first lighting circuit, a second lighting circuit, a third lighting circuit, and a controller. The first light source includes one or more first solid light emitting elements for emitting first color light and has a first range of an individual difference in chromaticity. The second light source includes one or more second solid light emitting elements for emitting second color light different in color from the first color light and has a second range of an individual difference in chromaticity. The third light source includes one or more third solid light emitting elements for emitting third color light different in color from the first color light and the second color light and has a third range of an individual difference in chromaticity. The first lighting circuit is configured to supply a first drive current according to a first desired value to the first light source. The second lighting circuit is configured to supply a second drive current according to a second desired value to the second light source. The third lighting circuit is configured to supply a third drive current according to a third desired value to the third light source. The controller is configured to provide the first desired value, the second desired value, and the third desired value to the first lighting circuit, the second lighting circuit, and the third lighting circuit, respectively. The controller is configured to, to adjust a color of illumination light composed of the first color light, the second color light, and the third color light, to a color represented by a desired chromaticity point, determine the first desired value, the second desired value, and the third desired value, based on a correction coefficient for correcting a chromaticity point of the first color light, a chromaticity point of the second color light, and a chromaticity point of the third color light to a first chromaticity point, a second chromaticity point, and a third chromaticity point, respectively. The first chromaticity point is defined as an intersection of a straight line in contact with the first range and the second range and another straight line in contact with the first range and the third range in a chromaticity diagram. The second chromaticity point is defined as an intersection of a straight line in contact with the second range and the first range and another straight line in contact with the second range and the third range in the chromaticity diagram. The third chromaticity point is defined as an intersection of a straight line in contact with the third range and the first range and another straight line in contact with the third range and the second range in the chromaticity diagram.

The lighting fixture of one aspect according to the present disclosure includes the lighting device of the above aspect, and a housing for bearing the lighting device.

The figures depict one or more implementation in accordance with the present teaching, by way of example only, not by way of limitations.

DETAILED DESCRIPTION

1. Embodiments

Hereinafter, one embodiment according to the present disclosure is described in detail with reference to drawings. Note that, the following embodiment is one of various embodiments according to the present disclosure. The embodiments according to the present disclosure are not limited to the following embodiment, and the following embodiment may be modified in various ways according to design or the like, providing that the objective of the present disclosure would be achieved.

Figure 1:
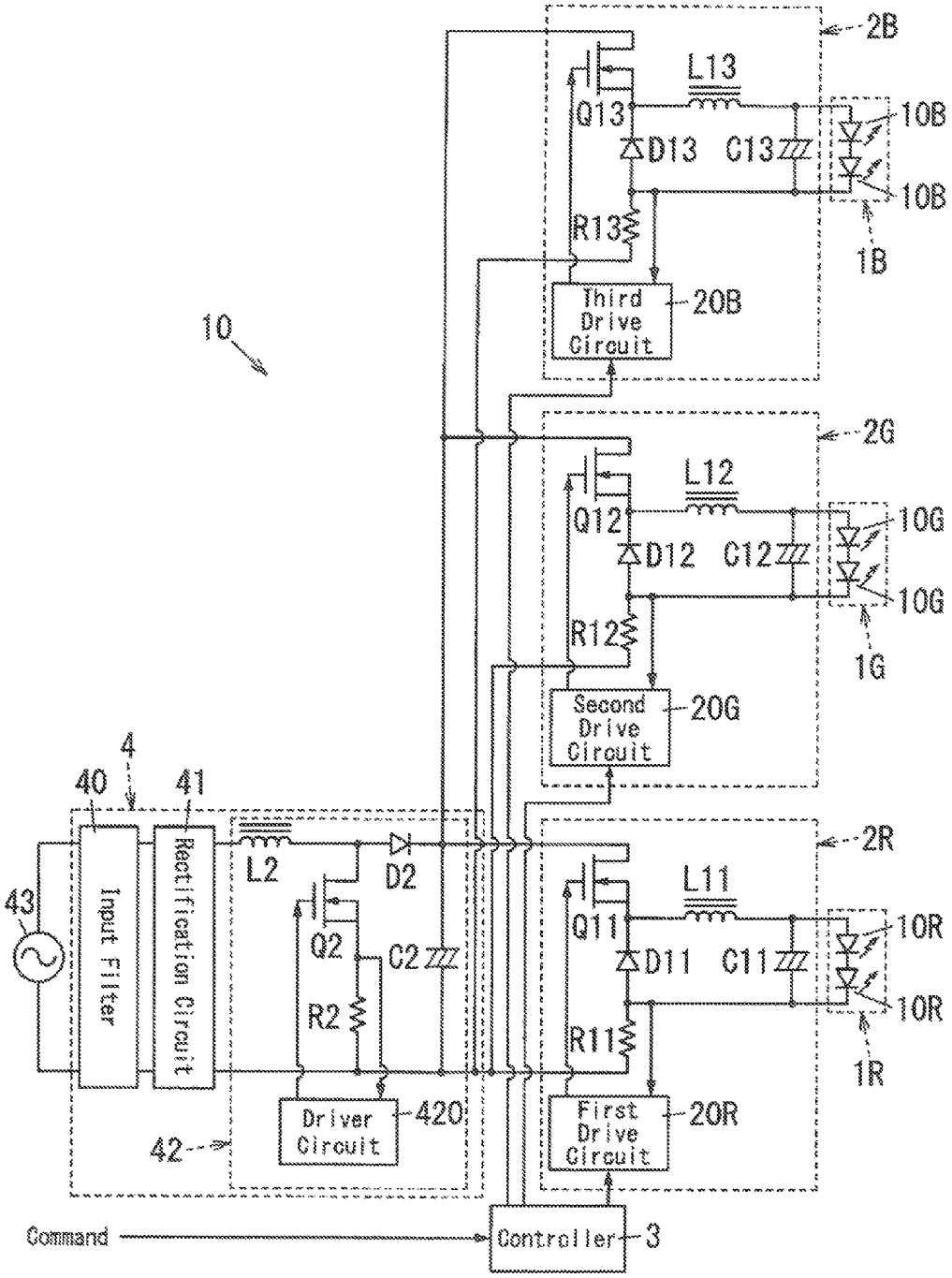
FIG. 1 is a configuration diagram of a circuit of a lighting device of one embodiment according to the present disclosure.

As shown in FIG. 1, the lighting device 10 of the present embodiment includes a first light source 1R, a second light source 1G, a third light source 1B, a first lighting circuit 2R, a second lighting circuit 2G, a third lighting circuit 2B, a controller 3, and a power supply 4. Note that, the power supply 4 is optional.

The first light source 1R includes a series circuit of multiple first solid light emitting elements 10R (only two of them are illustrated). Each first solid light emitting element 10R is a red light emitting diode for emitting red light (visible light with a wavelength of 615 to 635 [nm], for example). As apparent from the above, the first light source 1R may include one or more first solid light emitting elements 10R for emitting first color light (e.g., red light).

The second light source 1G includes a series circuit of multiple second solid light emitting elements 10G (only two of them are illustrated). Each second solid light emitting element 10G is a green light emitting diode for emitting green light (visible light with a wavelength of 520 to 535 [nm], for example). As apparent from the above, the second light source 1G may include one or more second solid light emitting elements 10G for emitting second color light (e.g., green light) different in color from the first color light.

The third light source 1B includes a series circuit of multiple third solid light emitting elements 10B (only two of them are illustrated). Each third solid light emitting element 10B is a blue light emitting diode for emitting blue light (visible light with a wavelength of 464 to 475 [nm], for example). As apparent from the above, the third light source 1B may include one or more third solid light emitting elements 10B for emitting third color light (e.g., blue light) different in color from the first color light and the second color light.

Note that, the first to third solid light emitting elements 10R, 10G, and 10B each may be a solid light emitting element other than a light emitting diode (inorganic light emitting diode), such as, an organic electroluminescence element. Further, the colors (wavelengths) of the solid light emitting elements 10R, 10G, and 10B are only examples, and they are not limited to the colors (wavelengths) described in the embodiment, and may be colors other than the three colors of red, green, and blue.

Note that, in the following description, light composed of (or obtained by mixing) the red light of the first light source 1R, the green light of the second light source 1G, and the blue light of the third light source 1B would be referred to as illumination light. The illumination light is defined as light to be emitted from a light source unit including the first light source 1R, the second light source 1G, and the third light source 1B. The illumination light does not always include all of the red light of the first light source 1R, the green light of the second light source 1G, and the blue light of the third light source 1B. This means that the illumination light would be interpreted as including at least one of the red light of the first light source 1R, the green light of the second light source 1G, and the blue light of the third light source 1B.

The power supply 4 is configured to convert AC power supplied from a commercial AC power supply 43 into DC power. For example, it is preferable that the power supply 4 includes an input filter 40, a rectification circuit 41, and a power factor improvement circuit 42. The input filter 40 is a high frequency blocking filter, and is configured to allow a power supply voltage of the AC power supply 43 with a designated frequency (60 [Hz] or 50 [Hz]) to pass, but block a high frequency component, for example. The rectification circuit 41 may preferably include a diode bridge, for example. The power factor improvement circuit 42 may preferably include a step-up chopper circuit. The power factor improvement circuit 42 includes a switching element Q2 being a field-effect transistor, a choke coil L2, a detection resistor R2, a diode D2, a smoothing capacitor C2, and a driver circuit 420 for switching the switching element Q2. The driver circuit 420 is configured to measure a voltage across the detection resistor R2, and control a duty cycle of the switching element Q2 to keep a voltage (output voltage) across the smoothing capacitor C2 constant.

The first lighting circuit 2R is configured to supply a drive current (first drive current) to the first light source 1R. Further, the first lighting circuit 2R is configured to change the first drive current according to a desired value (first desired value) $I_{RT}$ to be provided from the controller 3. The first lighting circuit 2R may include a step-down chopper circuit, for example. The first lighting circuit 2R includes a first switching element Q11, a first inductor L11, a first diode D11, a first capacitor C11, a first resistor R11, and a first drive circuit 20R. The first switching element Q11 may be an n-channel enhancement metal-oxide semiconductor field-effect transistor (MOSFET), for example. The first switching element Q11, the first diode D11, and the first resistor R11 constitute a series circuit electrically connected between opposite output terminals of the power supply 4 (opposite ends of the smoothing capacitor C2). Further, the first inductor L11 and the first capacitor C11 constitute a series circuit electrically connected between an anode and a cathode of the first diode D11. Moreover, the first light source 1R is electrically connected between opposite ends of the first capacitor C11.

The first drive circuit 20R is configured to control the duty cycle of the first switching element Q11 so that the first drive current flowing through the first resistor R11 (equivalent to a current flowing through the first light source 1R) is equal to the desired value $I_{RT}$. Alternatively, the first drive circuit 20R may adjust a ratio of a conduction period to a rest period. The conduction period is defined as a period in which switching control is performed on the first switching element Q11. The rest period is defined as a period in which switching control is not performed on the first switching element Q11.

The second lighting circuit 2G is configured to supply a drive current (second drive current) to the second light source 1G. Further, the second lighting circuit 2G is configured to change the second drive current according to a desired value (second desired value) $I_{GT}$ to be provided from the controller 3. The second lighting circuit 2G may include a step-down chopper circuit, for example. The second lighting circuit 2G includes a second switching element Q12, a second inductor L12, a second diode D12, a second capacitor C12, a second resistor R12, and a second drive circuit 20G. The second switching element Q12 may be an n-channel enhancement MOSFET, for example. The second switching element Q12, the second diode D12, and the second resistor R12 constitute a series circuit electrically connected between the opposite output terminals of the power supply 4. Further, the second inductor L12 and the second capacitor C12 constitute a series circuit electrically connected between an anode and a cathode of the second diode D12. Moreover, the second light source 1G is electrically connected between opposite ends of the second capacitor C12.

The second drive circuit 20G is configured to control the duty cycle of the second switching element Q12 so that the second drive current flowing through the second resistor R12 (equivalent to a current flowing through the second light source 1G) is equal to the desired value $I_{GT}$. Alternatively, the second drive circuit 20G may adjust a ratio of a conduction period to a rest period. The conduction period is defined as a period in which switching control is performed on the second switching element Q12. The rest period is defined as a period in which switching control is not performed on the second switching element Q12.

The third lighting circuit 2B is configured to supply a drive current (third drive current) to the third light source 1B. Further, the third lighting circuit 2B is configured to change the third drive current according to a desired value (third desired value) $I_{BT}$ to be provided from the controller 3. The third lighting circuit 2B may include a step-down chopper circuit, for example. The third lighting circuit 2B includes a third switching element Q13, a third inductor L13, a third diode D13, a third capacitor C13, a third resistor R13, and a third drive circuit 20B. The third switching element Q13 may be an n-channel enhancement MOSFET, for example. The third switching element Q13, the third diode D13, and the third resistor R13 constitute a series circuit electrically connected between the opposite output terminals of the power supply 4. Further, the third inductor L13 and the third capacitor C13 constitute a series circuit electrically connected between an anode and a cathode of the third diode D13. Moreover, the third light source 1B is electrically connected between opposite ends of the third capacitor C13.

The third drive circuit 20B is configured to control the duty cycle of the third switching element Q13 so that the third drive current flowing through the third resistor R13 (equivalent to a current flowing through the third light source 1B) is equal to the desired value $I_{BT}$. Alternatively, the third drive circuit 20B may adjust a ratio of a conduction period to a rest period. The conduction period is defined as a period in which switching control is performed on the third switching element Q13. The rest period is defined as a period in which switching control is not performed on the third switching element Q13.

The controller 3 is configured to individually control the first lighting circuit 2R, the second lighting circuit 2G, and the third lighting circuit 2B to change the first drive current, the second drive current, and the third drive current to adjust a light amount of the first light source 1R, a light amount of the second light source 1G, and a light amount of the third light source 1B, respectively. As apparent from the above, the controller 3 may be configured to control the first lighting circuit 2R, the second lighting circuit 2G, and the third lighting circuit 2B to adjust a color of the illumination light.

The controller 3 may include a microcontroller including one or more central processing units (CPU) and one or more memories, for example. The controller 3 executes programs in the one or more memories with the one or more CPUs to realize various processing as described herein.

For example, when receiving a command from an external device for dimming, the controller 3 performs an operation of making the color of the illumination light identical to a color of light requested by the command. The external device (not shown) for dimming may be a dimming control panel, for example. The dimming control panel may include multiple input devices so-called faders, for example. The multiple faders have operated positions corresponding to the light amounts of the respective colors of the red light, the green light, and the blue light. In summary, the dimming control panel is configured to generate the instruction values $L_{[R\text{-}req]}$, $L_{[G\text{-}req]}$, and $L_{[B\text{-}req]}$ for the respective light amounts of the red light, the green light, and the blue light based on the operated positions of the respective faders to be manually operated by an operator (user), and transmit the command including the generated instruction values $L_{[R\text{-}req]}$, $L_{[G\text{-}req]}$, and $L_{[B\text{-}req]}$ to the controller 3 of the lighting device 10. Hereinafter, if necessary, the instruction value $L_{[R\text{-}req]}$ for the light amount of the red light, the instruction value $L_{[G\text{-}req]}$ for the light amount of the green light, and the instruction value $L_{[B\text{-}req]}$ for the light amount of the blue light are referred to as the first instruction value, the second instruction value, and the third instruction value, respectively. Note that, the controller 3 may operate to make the color of the illumination light identical to a predetermined color when a current time becomes predetermined time.

The controller 3 is configured to, when receiving the command to be transmitted from the dimming control panel, subject the instruction values $L_{[R\text{-}req]}$, $L_{[G\text{-}req]}$, and $L_{[B\text{-}req]}$ of the respective light amounts included in the received command to a color correction process described later. Thereby, the controller 3 obtains the instruction values (correction values) $L_{[R\text{-}sum]}$, $L_{[G\text{-}sum]}$, and $L_{[B\text{-}sum]}$ of the respective light amounts resulting from the color correction process. Additionally, the controller 3 is configured to convert the instruction values $L_{[R\text{-}sum]}$, $L_{[G\text{-}sum]}$, and $L_{[B\text{-}sum]}$ of the respective light amounts resulting from the color correction process into the desired values $I_{RT}$, $I_{GT}$, and $I_{BT}$ of the drive currents for the respective light sources 1R, 1G, and 1B, and then provide the desired values $I_{RT}$, $I_{GT}$, and $I_{BT}$ to the drive circuits 20R, 20G, and 20B of the lighting circuits 2R, 2G, and 2B, respectively.

Consequently, the first drive circuit 20R controls the duty cycle of the first switching element Q11 so as to make the first drive current supplied to the first light source 1R equal to the desired value $I_{RT}$ of the red light received from the controller 3. Similarly, the second drive circuit 20G controls the duty cycle of the second switching element Q12 so as to make the second drive current supplied to the second light source 1G equal to the desired value $I_{GT}$ of the green light received from the controller 3. Likewise, the third drive circuit 20B controls the duty cycle of the third switching element Q13 so as to make the third drive current supplied to the third light source 1B equal to the desired value $I_{BT}$ of the blue light received from the controller 3. As a result, the color of the illumination light emitted from the lighting device 10 is adjusted to a color designated by the operator with the dimming control panel.

Next, a lighting fixture 100 including the lighting device 10 according to the present embodiment is described with reference to FIG. 2 to FIG. 7. The lighting fixture 100 may be used to illuminate a background wall surface (cyclorama)

of a studio of a TV station, a stage, or the like, and therefore may be a cyclorama light. Note that, embodiments according to the present disclosure are not limited to cyclorama lights.

As shown in FIG. 2 to FIG. 6, the lighting fixture 100 includes a light source unit 5 and a power source unit 6. In the following description, forward, rearward, left, right, upward, and downward directions of the lighting fixture 100 correspond to forward, rearward, left, right, upward, and downward directions shown in FIG. 2. For example, the left side of the sheet of FIG. 2 corresponds to the front side of the lighting fixture 100, and the right side of the sheet of FIG. 2 corresponds to the rear side of the lighting fixture 100. Additionally, the upper side of the sheet of FIG. 2 corresponds to the left side of the lighting fixture 100, and the lower side of the sheet of FIG. 2 corresponds to the right side of the lighting fixture 100.

Figure 3:
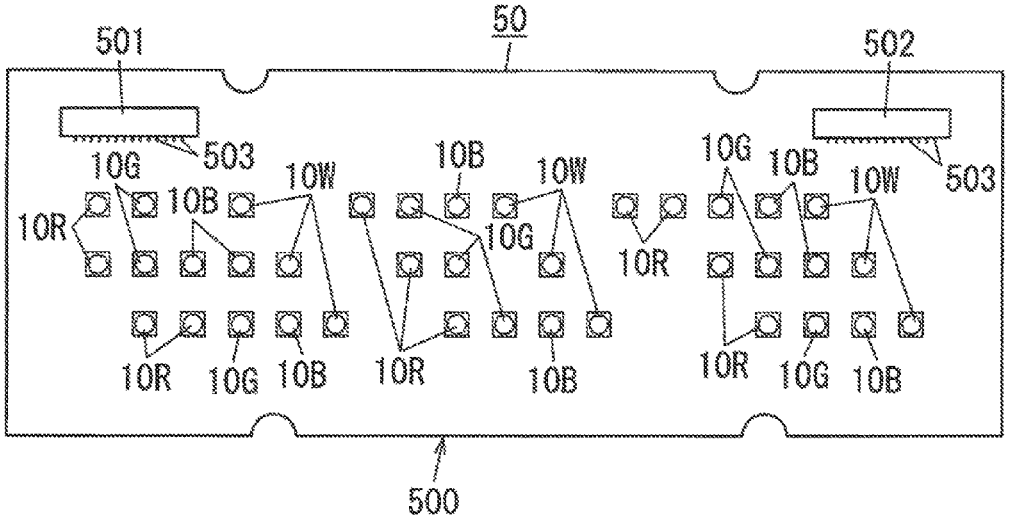
FIG. 3 is a front view of an LED module of the lighting fixture of the embodiment.

The light source unit 5 includes four LED modules 50 (see FIG. 5), a first housing 51, a reflection plate block 52, and a heat dissipation plate block 53. As shown in FIG. 3, the LED module 50 includes a substrate 500 in a rectangular shape, and further includes multiple first solid light emitting elements 10R, multiple second solid light emitting elements 10G, and multiple third solid light emitting elements 10B which are mounted on a surface of the substrate 500. In such way, the light source unit 5 includes the first light source 1R, the second light source 1G, and the third light source 1B of the lighting device 10.

Note that, it is preferable that the lighting fixture 100 be configured so that multiple (nine in the illustration) fourth solid light emitting elements 10W are mounted on the surface of the substrate 500 in addition to the multiple first solid light emitting elements 10R, the multiple second solid light emitting elements 10G, and the multiple third solid light emitting elements 10B. These multiple fourth solid light emitting elements 10W constitute a fourth light source, and the fourth light source is to emit light (be turned on) when receiving DC power to be supplied from the fourth lighting circuit. Note that, the fourth lighting circuit preferably may have the same circuit configuration as the first lighting circuit 2R, the second lighting circuit 2G, and the third lighting circuit 2B.

Further, it is preferable that receptacle connectors 501 and 502 be mounted on opposite ends of the surface of the substrate 500 in a lengthwise direction. The receptacle connectors 501 and 502 each include multiple terminals 503 electrically connected to individual groups of the solid light emitting elements 10R, 10G, 10B, and 10W, through conductors (copper foil) formed on the surface or the opposite surface of the substrate 500. Further, the receptacle connectors 501 and 502 are electrically connected to output terminals of the first lighting circuit 2R, the second lighting circuit 2G, the third lighting circuit 2B, and the fourth lighting circuit, via electrical cables.

The first housing 51 has a cuboidal shape, and is formed of a metal plate. The first housing 51 has a rectangular window hole 510 in its front face. The four LED modules 50 are housed in the first housing 51 with their surfaces exposed via the window hole 510, and are arranged in a 2 by 2 matrix (see FIG. 5).

Figure 2:
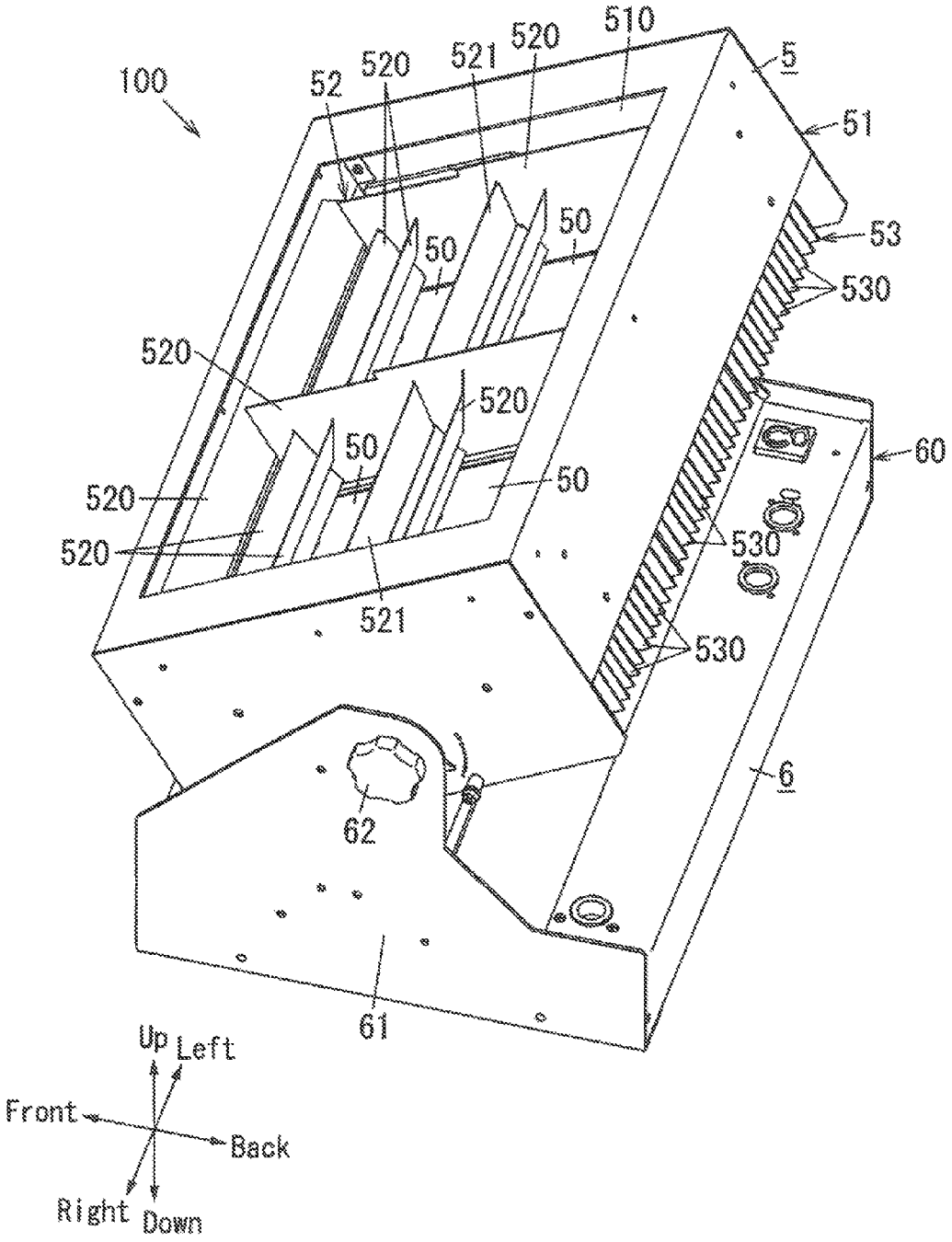
FIG. 2 is a perspective view of a lighting fixture of the embodiment.
Figure 4:
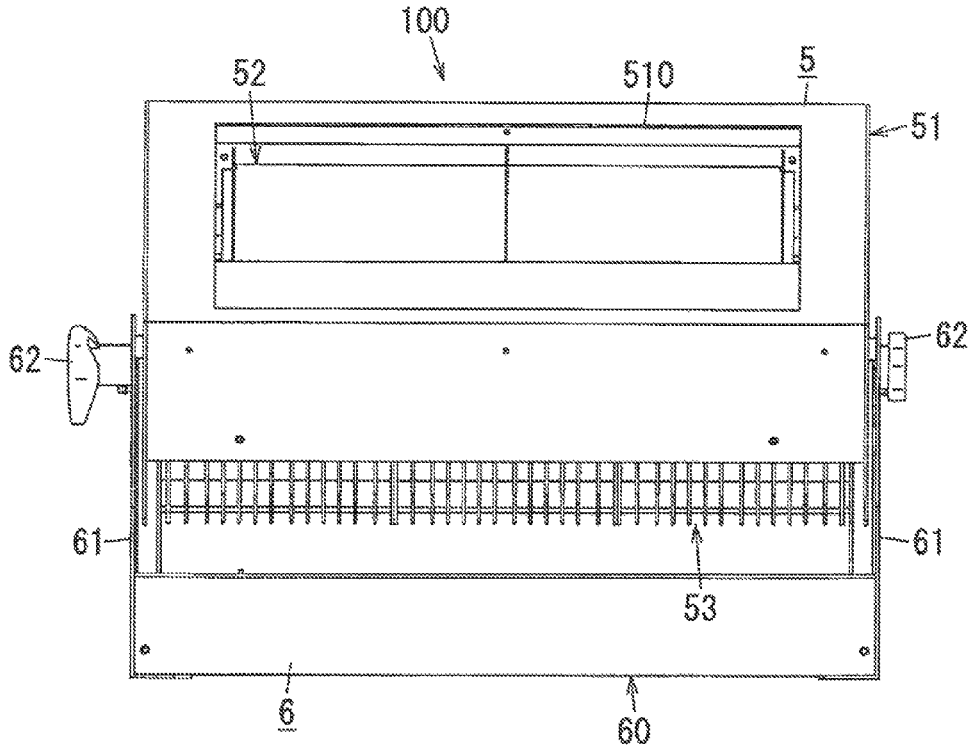
FIG. 4 is a plan view of the lighting fixture of the embodiment.
Figure 5:
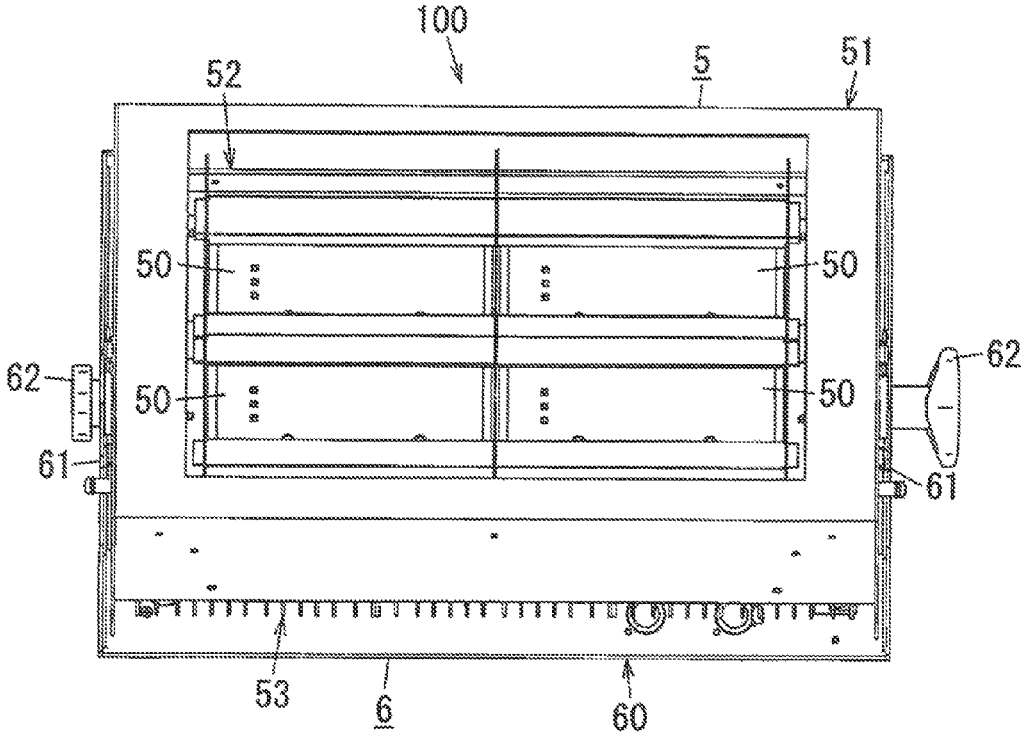
FIG. 5 is a front view of the lighting fixture of the embodiment.

The reflection plate block 52 may preferably include multiple reflective plates 520 and a light blocking plate 521 (see FIG. 2, FIG. 4, and FIG. 5). The multiple reflective plates 520 and the light blocking plate 521 are positioned between the window hole 510 and the surfaces of the LED modules 50 inside the first housing 51, so as to control distribution of light to be emitted from the LED modules 50.

The heat dissipation plate block 53 may preferably include multiple heat dissipating plates 530 which are arranged in thickness directions thereof at regular intervals (see FIG. 2). The heat dissipation plate block 53 is provided to a rear surface of the first housing 51. Note that, the heat dissipation plate block 53 may preferably be thermally coupled with the LED modules 50 (the substrates 500 thereof) inside the first housing 51.

The power source unit 6 includes a circuit block, a second housing 60 for accommodating the circuit block, and a pair of arms 61. The circuit block includes the first lighting circuit 2R, the second lighting circuit 2G, the third lighting circuit 2B, the fourth lighting circuit, the controller 3, and the power supply 4. The power source unit 6 thus includes the first lighting circuit 2R, the second lighting circuit 2G, the third lighting circuit 2B, the controller 3, and the power supply 4 of the lighting device 10.

The circuit block includes multiple printed wiring boards, and circuit parts constituting the first lighting circuit 2R, the second lighting circuit 2G, the third lighting circuit 2B, the fourth lighting circuit, the controller 3, and the power supply 4 mounted thereon.

Figure 6:
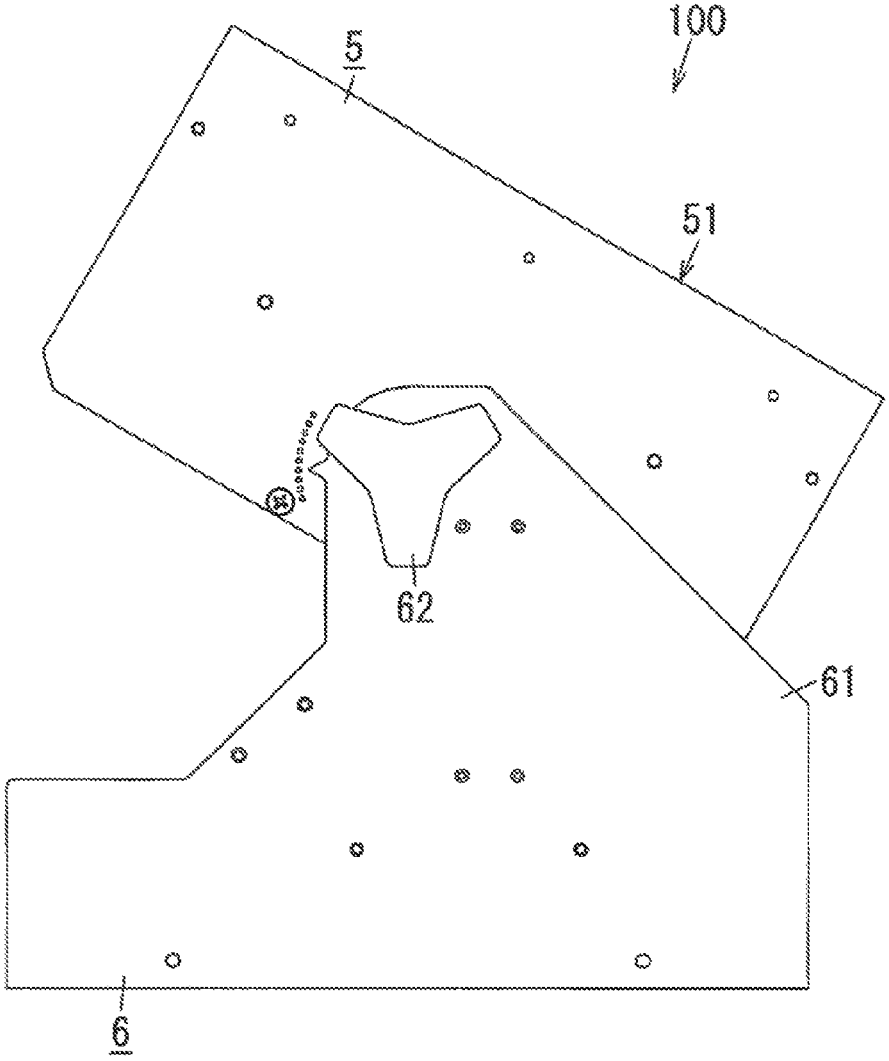
FIG. 6 is a left view of the lighting fixture of the embodiment.

The second housing 60 has a flat cuboidal shape, and is formed of a metal plate. The second housing 60 is configured to accommodate the circuit block (see FIG. 2). The pair of arms 61 extends upright from left and right ends of the second housing 60 (see FIG. 2, FIG. 4, and FIG. 5). As shown in FIG. 6, the width (dimension in the forward and rearward direction) of each of the pair of the arms 61 becomes gradually smaller toward an end (upper end). There are insertion holes provided to the ends of the pair of arm 61. Each insertion hole allows passage of a bolt part of a nob bolt 62. The bolt parts are screwed into threaded holes provided to left and right side surfaces of the first housing 51 through the insertion holes of the ends of the pair of arms 61, and thereby the light source unit 5 is rotatively held by the pair of arms 61.

As apparent from the above, the lighting fixture 100 includes the first light source 1R, the second light source 1G, the third light source 1B, the first lighting circuit 2R, the second lighting circuit 2G, the third lighting circuit 2B, the controller 3, and the power supply 4 which constitute the lighting device 10. Further, the lighting fixture 100 includes: the first housing 51 for bearing (accommodating) the first light source 1R, the second light source 1G, and the third light source 1B; and the second housing 60 for bearing (accommodating) the first lighting circuit 2R, the second lighting circuit 2G, the third lighting circuit 2B, the controller 3, and the power supply 4. In short, the lighting fixture 100 includes the lighting device 10 and a housing (the first housing 51 and the second housing 60) for bearing the lighting device 10.

Figure 7:
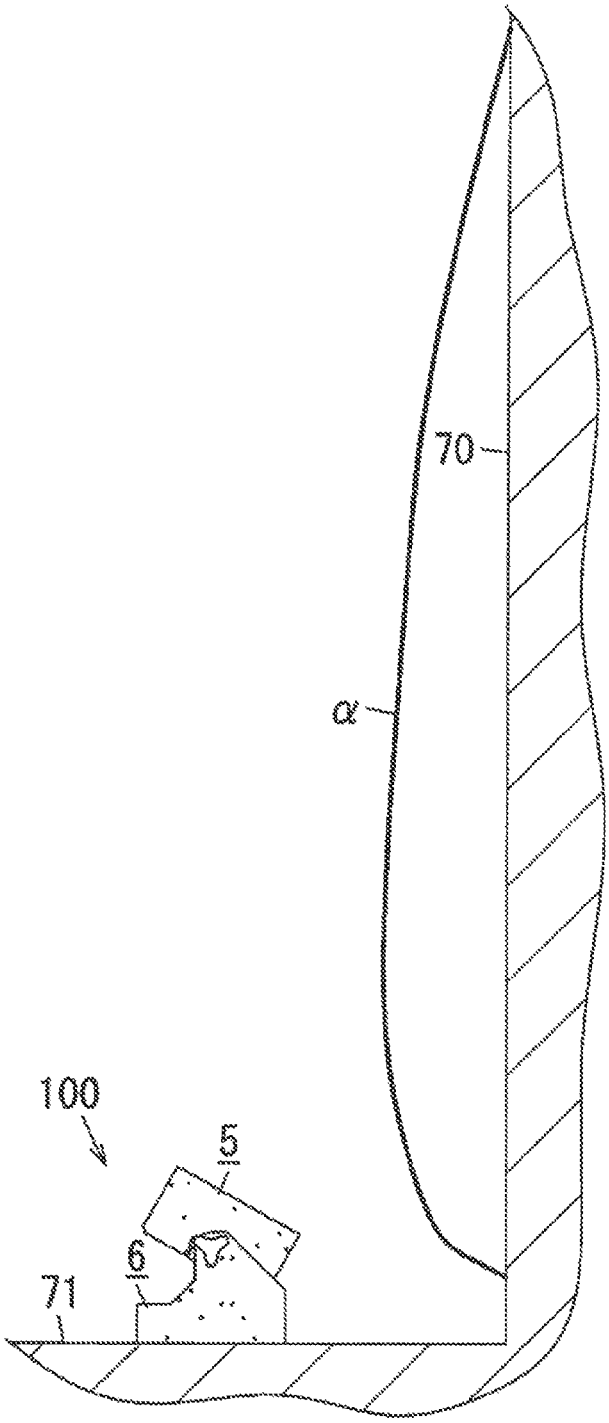
FIG. 7 is an explanatory diagram for a light distribution property of the lighting fixture of the embodiment.

FIG. 7 illustrates a situation in which the lighting fixture 100 is in use. For example, the lighting fixture 100 is situated on a floor 71 to be apart from a background wall surface 70 so that the window hole 510 of the light source unit 5 faces the background wall surface 70. FIG. 7 shows a solid line $\alpha$ representing a light distribution property of the lighting fixture 100. The solid line $\alpha$ of FIG. 7 shows that the lighting fixture 100 can irradiate an area of the background wall surface 70 extending from the lower part close to the floor 71 to the upper part with the almost uniform illumination light.

Note that, a lighting fixture such as a cyclorama light is not always used alone. In some cases, multiple lighting fixtures may be arranged on the floor 71 to simultaneously illuminate the single background wall surface 70. In the case where the multiple lighting fixtures simultaneously illuminate the single background wall surface 70, audience or viewer may feel strange or uncomfortable if there are relatively large differences in chromaticity of the illumination light between the lighting fixtures. In view of this, the lighting fixture 100 (the lighting device 10) corrects the instruction values $L_{[R\text{-}req]}$, $L_{[G\text{-}req]}$, and $L_{[B\text{-}req]}$ for the respective light colors provided from the dimming control panel, and thereby suppressing differences in chromaticity of the illumination light between the multiple lighting fixtures 100 (the lighting devices 10).

Next, the color correction process performed by the controller 3 of the lighting device 10 is described in detail with reference to FIG. 8.

For example, with regard to the lighting device 10, an individual difference in chromaticity of the illumination light depends on a rank of a red light emitting diode used as the first solid light emitting element 10R, a rank of a green light emitting diode used as the second solid light emitting element 10G, and a rank of a blue light emitting diode used as the third solid light emitting element 10B. Such a rank represents that a rated chromaticity of a light emitting diode is present in a range in a chromaticity diagram associated with the rank. The rated chromaticity point may be defined as a chromaticity point of light emitted from a light emitting diode when a predetermined current (rated current) flows through the light emitting diode, for example. The range in the chromaticity diagram associated with the rank can be considered a range of an individual difference in chromaticity.

Therefore, the first light source 1R (the first solid light emitting element 10R), the second light source 1G (the second solid light emitting element 10G), and the third light source 1B (the third solid light emitting element 10B) have ranges (a first range, a second range, and a third range) 11R, 11G, and 11B of individual differences in chromaticity.

Figure 8:
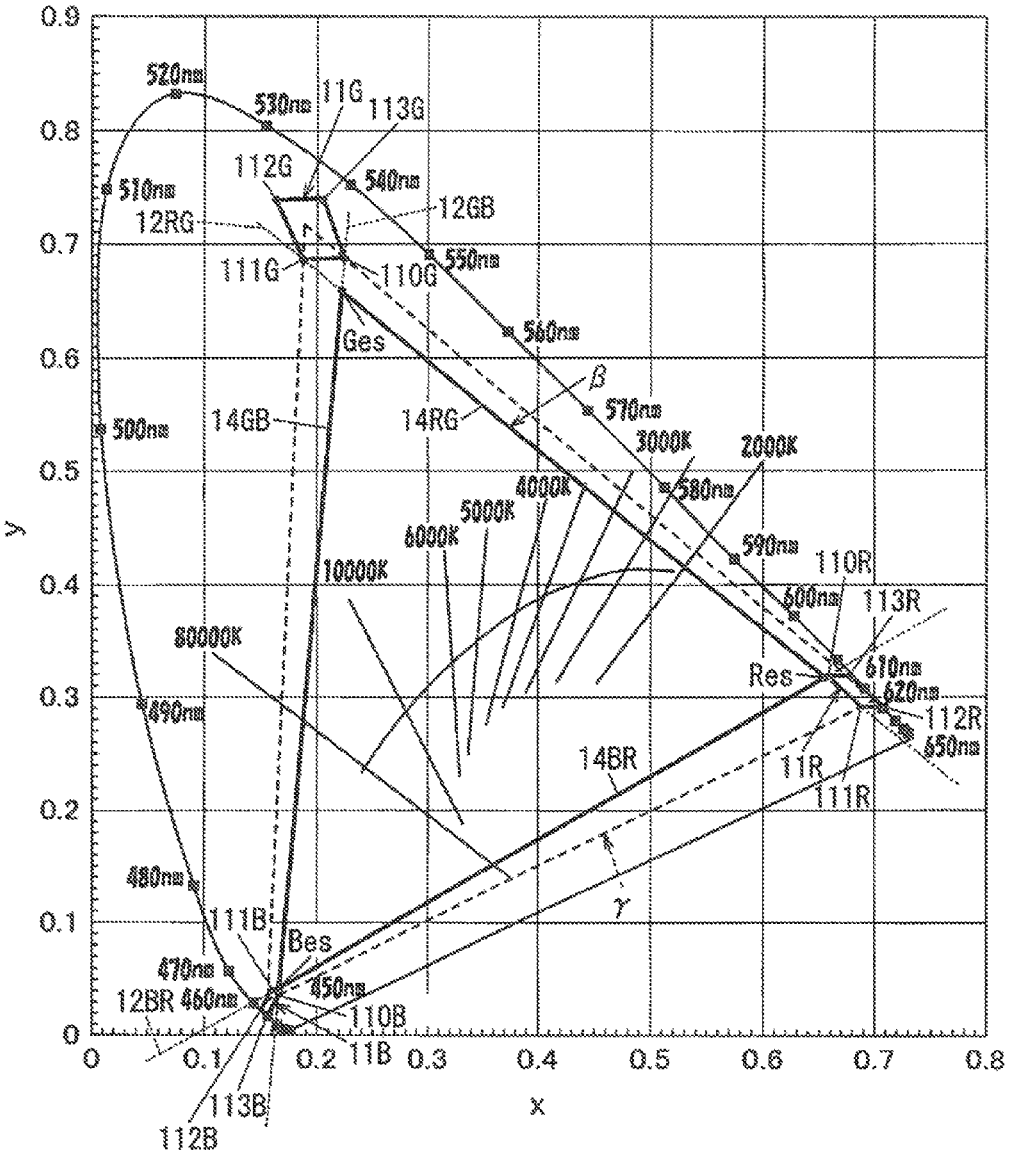
FIG. 8 is a chromaticity diagram for illustrating a color correction process performed by the lighting device and the lighting fixture of the embodiment.

For example, in an xy-chromaticity diagram of FIG. 8, the first, second, and third ranges 11R, 11G, and 11B are supposed to be represented as quadrangles (parallelograms). It is ensured that, when the rated current is supplied to the multiple first solid light emitting elements 10R, the chromaticity points (rated chromaticity points) of the multiple first solid light emitting elements 10R are in the first range 11R. However, it is not ensured the multiple first solid light emitting elements 10R have the same rated chromaticity point. This means that the red light emitting diodes have individual differences. The second solid light emitting elements 10G, and the third solid light emitting elements 10B also have individual differences in chromaticity.

For this reason, even if the same desired values $I_{RT}$, $I_{GT}$, and $I_{BT}$ for the currents to the first light source 1R, the second light source 1G, and the third light source 1B are provided to the lighting devices, the lighting devices may emit the illumination light with different chromaticity due to the individual differences in chromaticity of the respective solid light emitting elements 10R, 10G, and 10B if the lighting devices do not perform the color correction process.

In view of this, when the first, second, and third ranges 11R, 11G, and 11B of the red light, the green light, and the blue light are already known, the chromaticity points (the first rated chromaticity point, the second rated chromaticity point, and the third rated chromaticity point) of the red light, the green light, and the blue light are corrected based on the first, second, and third range 11R, 11G, and 11B. Thus, the desired values $I_{RT}$, $I_{GT}$, and $I_{BT}$ for the respective currents are determined according to a correction coefficient including coefficients used for a correction to obtain a corrected chromaticity point (first chromaticity point Res) of the red light, a correction to obtain a corrected chromaticity point (second chromaticity point Ges) of the green light, and a correction to obtain a corrected chromaticity point (third chromaticity point Bes) of the blue light. In other words, the desired values $I_{RT}$, $I_{GT}$, and $I_{BT}$ for the red light with the first rated chromaticity point, the green light with the second rated chromaticity point, and the blue light with the third rated chromaticity point are corrected to desired values $I_{RT}$, $I_{GT}$, and $I_{BT}$ for the red light with the first chromaticity point Res, the green light with the second chromaticity point Ges, and the blue light with the third chromaticity point Bes, respectively.

Next, how to determine the first chromaticity point Res, the second chromaticity point Ges, and the third chromaticity point Bes is described.

For example, four vertexes of a parallelogram representing the first range 11R of the red light in the xy-chromaticity diagram are defined as a first vertex 110R, a second vertex 111R, a third vertex 112R, and a fourth vertex 113R. Further, four vertexes of a parallelogram representing the second range 11G of the green light in the xy-chromaticity diagram are defined as a first vertex 110G, a second vertex 111G, a third vertex 112G, and a fourth vertex 113G. Moreover, four vertexes of a parallelogram representing the third range 11B of the blue light in the xy-chromaticity diagram are defined as a first vertex 110B, a second vertex 111B, a third vertex 112B, and a fourth vertex 113B (see FIG. 8).

In this regard, a straight line touching the first range 11R of the red light and the second range 11G of the green light, that is, a straight line 12RG passing through the second vertex 111R of the first range 11R and the second vertex 111G of the second range 11G is found. The straight line 12RG is a straight line closest to the third range 11B of straight lines touching the first range 11R and the second range 11G without crossing the first range 11R and the second range 11G in the chromaticity diagram. Further, a straight line touching the second range 11G of the green light and the third range 11B of the blue light, that is, a straight line 12GB passing through the first vertex 110G of the second range 11G and the first vertex 110B of the third range 11B is found. The straight line 12GB is a straight line closest to the first range 11R of straight lines touching the second range 11G and the third range 11B without crossing the second range 11G and the third range 11B in the chromaticity diagram. Additionally, a straight line touching the third range 11B of the blue light and the first range 11R of the red light, that is, a straight line 12BR passing through the second vertex 111B of the third range 11B and the first vertex 110R of the first range 11R is found. The straight line 12BR is a straight line closest to the second range 11G of straight lines touching the third range 11B and the first range 11R without crossing the third range 11B and the first range 11R in the chromaticity diagram. Note that, the ranges 11R, 11G, and 11B of the respective color light is not always represented by boundaries in a strict sense, and thus are represented by lines (approximate boundaries) considered to represent boundaries.

The first chromaticity point Res is defined by an intersection of the two straight lines (the first straight line and the second straight line) 12RG and 12BR. The second chromaticity point Ges is defined by an intersection of the two straight lines (the first straight line and the third straight line) 12RG and 12GB. The third chromaticity point Bes is defined by an intersection of the two straight lines (the third straight line and the second straight line) 12GB and 12BR. In this regard, a triangle β with three sides defined by a section 14RG interconnecting the first chromaticity point Res and the second chromaticity point Ges, a section 14GB interconnecting the second chromaticity point Ges and the third chromaticity point Bes, and a section 14BR interconnecting the third chromaticity point Bes and the first chromaticity point Res is formed. This triangle β is considered to represent a color reproduction range (i.e., a corrected color reproduction range) of the lighting device 10 (see FIG. 8). Note that, a triangle γ represented with broken lines in FIG. 8 is a triangle with vertexes denoting the chromaticity points of respective color light which are not corrected.

Next steps are determining combinations of light amounts of the first light source 1R, the second light source 1G, and the third light source 1B necessary for making the chromaticity point of the illumination light composed of the red light of the first light source 1R, the green light of the second light source 1G, and the blue light of the third light source 1B equal to the first chromaticity point Res, the second chromaticity point Ges, and the third chromaticity point Bes, respectively.

For example, the light amounts (luminous fluxes) of the red light of the first light source 1R, the green light of the second light source 1G, and the blue light of the third light source 1B which are necessary for allowing the illumination light to have the chromaticity point equal to the first chromaticity point Res are denoted by $L_{[R\text{-}Res]}$, $L_{[G\text{-}Res]}$, and $L_{[B\text{-}Res]}$, respectively. Further, the light amounts of the red light of the first light source 1R, the green light of the second light source 1G, and the blue light of the third light source 1B which are necessary for allowing the illumination light to have the chromaticity point equal to the second chromaticity point Ges are denoted by $L_{[R\text{-}Ges]}$, $L_{[G\text{-}Ges]}$, and $L_{[B\text{-}Ges]}$, respectively. Additionally, the light amounts of the red light of the first light source 1R, the green light of the second light source 1G, and the blue light of the third light source 1B which are necessary for allowing the illumination light to have the chromaticity point equal to the third chromaticity point Bes are denoted by $L_{[R\text{-}Bes]}$, $L_{[G\text{-}Bes]}$, and $L_{[B\text{-}Bes]}$, respectively. Note that, it is preferable that the light amounts of the light sources 1R, 1G, and 1B be expressed in percent of the light amounts observed when the rated currents flow through the light sources 1R, 1G, and 1B, respectively.

In this regard, chromaticity coordinates (chromaticity coordinates of the rated chromaticity point) of the red light of the first light source 1R are denoted by ($Cx_{[R]}$, $Cy_{[R]}$), chromaticity coordinates (chromaticity coordinates of the rated chromaticity point) of the green light of the second light source 1G are denoted by ($Cx_{[G]}$, $Cy_{[G]}$), and chromaticity coordinates (chromaticity coordinates of the rated chromaticity point) of the blue light of the third light source 1B are denoted by ($Cx_{[B]}$, $Cy_{[B]}$). Further, the light amount of the first light source 1R is denoted by $L_{[R]}$, the light amount of the second light source 1G is denoted by $L_{[G]}$, and the light amount of the third light source 1B is denoted by $L_{[B]}$. Additionally, chromaticity coordinates of the illumination light is denoted by (Cx, Cy) and a light amount of the illumination light is denoted by L. According to this situation, the following formulae can be obtained based on additive color mixing.

$$Cx = \frac{\left(L_{[R]}\frac{Cx_{[R]}}{Cy_{[R]}} + L_{[G]}\frac{Cx_{[G]}}{Cy_{[G]}} + L_{[B]}\frac{Cx_{[B]}}{Cy_{[B]}}\right)}{\left(\frac{L_{[R]}}{Cy_{[R]}} + \frac{L_{[G]}}{Cy_{[G]}} + \frac{L_{[B]}}{Cy_{[B]}}\right)} \quad \text{[FORMULA 1]}$$

-continued $$Cy = \frac{(L_{[R]} + L_{[G]} + L_{[B]})}{\left(\frac{L_{[R]}}{Cy_{[R]}} + \frac{L_{[G]}}{Cy_{[G]}} + \frac{L_{[B]}}{Cy_{[B]}}\right)} \quad \text{[FORMULA 2]}$$

$$L = L_{[R]} + L_{[G]} + L_{[B]} \quad \text{[FORMULA 3]}$$

Solving the above three equations for each of $L_{[R]}$, $L_{[G]}$, and $L_{[B]}$ will give the following formulae.

$$L_{[R]} = \frac{Cy_{[R]}}{Cy} L \frac{(Cy_{[B]} - Cy)(Cx_{[G]}Cy_{[B]} - Cx_{[B]}Cy_{[G]}) - (Cy_{[B]} - Cy_{[G]})(CxCy_{[B]} - CyCx_{[B]})}{Cy_{[B]} - Cy_{[R]})(Cx_{[G]}Cy_{[B]} - Cx_{[B]}Cy_{[G]}) + (Cy_{[B]} - Cy_{[G]})(Cx_{[B]}Cy_{[R]} - Cx_{[R]}Cy_{[B]})} \quad \text{[FORMULA 4]}$$

$$L_{[G]} = \frac{Cy_{[G]}}{Cy} L \frac{(Cy_{[B]} - Cy)(Cx_{[B]}Cy_{[R]} - Cx_{[R]}Cy_{[B]}) - (Cy_{[R]} - Cy_{[B]})(CxCy_{[B]} - CyCx_{[B]})}{Cy_{[B]} - Cy_{[R]})(Cx_{[G]}Cy_{[B]} - Cx_{[B]}Cy_{[G]}) + (Cy_{[B]} - Cy_{[G]})(Cx_{[B]}Cy_{[R]} - Cx_{[R]}Cy_{[B]})} \quad \text{[FORMULA 5]}$$

$$L_{[B]} = \frac{Cy_{[B]}}{Cy} L \frac{(Cy_{[R]} - Cy)(Cx_{[G]}Cy_{[R]} - Cx_{[R]}Cy_{[G]}) - (Cy_{[R]} - Cy_{[G]})(CxCy_{[R]} - CyCx_{[R]})}{Cy_{[R]} - Cy_{[B]})(Cx_{[G]}Cy_{[R]} - Cx_{[R]}Cy_{[G]}) + (Cy_{[R]} - Cy_{[G]})(Cx_{[R]}Cy_{[B]} - Cx_{[B]}Cy_{[R]})} \quad \text{[FORMULA 6]}$$

Therefore, by putting in the chromaticity coordinates and the light amount of the first chromaticity point Res for the chromaticity coordinates (Cx, Cy) and the light amount L of the illumination light, the respective light amounts $L_{[R\text{-}Res]}$, $L_{[G\text{-}Res]}$, and $L_{[B\text{-}Res]}$ of the red light of the first light source 1R, the green light of the second light source 1G, and the blue light of the third light source 1B can be calculated. Similarly, by putting in the chromaticity coordinates and the light amount of the second chromaticity point Ges for the chromaticity coordinates (Cx, Cy) and the light amount L of the illumination light, the respective light amounts $L_{[R\text{-}Ges]}$, $L_{[G\text{-}Ges]}$, and $L_{[B\text{-}Ges]}$ of the red light of the first light source 1R, the green light of the second light source 1G, and the blue light of the third light source 1B can be calculated. Likewise, by putting in the chromaticity coordinates and the light amount of the third chromaticity point Bes for the chromaticity coordinates (Cx, Cy) and the light amount L of the illumination light, the respective light amounts $L_{[R\text{-}Bes]}$, $L_{[G\text{-}Bes]}$, and $L_{[B\text{-}Bes]}$ of the red light of the first light source 1R, the green light of the second light source 1G, and the blue light of the third light source 1B can be calculated.

In manufacturing the lighting device 10, the rated light amount and the rated chromaticity coordinates of each of the first light source 1R, the second light source 1G, and the third light source 1B is measured, and then combinations of the light amounts of the respective light sources 1R, 1G, and 1B corresponding to the respective chromaticity points Res, Ges and Bes are calculated from the measured values and the formulae 4 to 6. Note that, it is preferable calculated light amounts be expressed in percent of the light amounts observed when the rated currents flow through the light sources 1R, 1G, and 1B, respectively.

It is preferable that the combinations of the light amounts (ratios) of the light sources 1R, 1G, and 1B corresponding to the respective chromaticity points Res, Ges, and Bes calculated as described above be included in a data table for the color correction process shown in TABLE 1 described below, and stored in the memory (e.g., an electrically rewritable semiconductor memory such as a flash memory) of the controller 3.

For example, the data table of TABLE 1 shows that the light amounts $L_{[R\text{-}Res]}$, $L_{[G\text{-}Res]}$, and $L_{[B\text{-}Res]}$ of the first chromaticity point Res are 95.00, 3.00, and 2.00, respectively. Further, the data table of TABLE 1 shows that the light amounts $L_{[R\text{-}Ges]}$, $L_{[G\text{-}Ges]}$, and $L_{[B\text{-}Ges]}$ of the second chromaticity point Ges are 5.00, 90.00, and 5.00, respectively. Additionally, the data table of TABLE 1 shows that the light amounts $L_{[R\text{-}Bes]}$, $L_{[G\text{-}Bes]}$, and $L_{[B\text{-}Bes]}$ of the third chromaticity point Bes are 0.00, 7.00, and 93.00, respectively. Note that, the ratio of the light amounts in terms of each of the first chromaticity point Res, the second chromaticity point Ges, and the third chromaticity point Bes is still kept constant even if the light amount (dimming level) of the illumination light varies between 100% and 1%.

TABLE 1

| Dimming | Res | | | Ges | | |
|---|---|---|---|---|---|---|
| Level | $L_{[R\text{-}Res]}$ | $L_{[G\text{-}Res]}$ | $L_{[B\text{-}Res]}$ | $L_{[R\text{-}Ges]}$ | $L_{[G\text{-}Ges]}$ | $L_{[B\text{-}Ges]}$ |
| 100% | 95.00 | 3.00 | 2.00 | 5.00 | 90.00 | 5.00 |
| 99% | 94.05 | 2.97 | 1.98 | 4.95 | 89.10 | 4.95 |
| 98% | 93.10 | 2.94 | 1.96 | 4.90 | 88.20 | 4.90 |
| 97% | 92.15 | 2.91 | 1.94 | 4.85 | 87.30 | 4.85 |
| . | . | . | . | . | . | . |
| . | . | . | . | . | . | . |
| . | . | . | . | . | . | . |
| 4% | 3.80 | 0.12 | 0.08 | 0.20 | 0.36 | 0.20 |
| 3% | 2.85 | 0.09 | 0.06 | 0.15 | 0.27 | 0.15 |
| 2% | 1.90 | 0.06 | 0.04 | 0.10 | 0.18 | 0.10 |
| 1% | 0.95 | 0.03 | 0.02 | 0.05 | 0.09 | 0.05 |

| Dimming | Bes | | | Rated Output | | |
|---|---|---|---|---|---|---|
| Level | $L_{[R\text{-}Bes]}$ | $L_{[G\text{-}Bes]}$ | $L_{[B\text{-}Bes]}$ | $L_{[R]}$ | $L_{[G]}$ | $L_{[B]}$ |
| 100% | 0.00 | 7.00 | 93.00 | 100.00 | 100.00 | 100.00 |
| 99% | 0.00 | 6.93 | 92.07 | 99.00 | 99.00 | 99.00 |
| 98% | 0.00 | 6.86 | 91.14 | 98.00 | 98.00 | 98.00 |
| 97% | 0.00 | 6.79 | 90.21 | 97.00 | 97.00 | 97.00 |
| . | . | . | . | . | . | . |
| . | . | . | . | . | . | . |
| . | . | . | . | . | . | . |
| 4% | 0.00 | 0.28 | 3.72 | 4.00 | 4.00 | 4.00 |
| 3% | 0.00 | 0.21 | 2.79 | 3.00 | 3.00 | 3.00 |
| 2% | 0.00 | 0.14 | 1.86 | 2.00 | 2.00 | 2.00 |
| 1% | 0.00 | 0.07 | 0.93 | 1.00 | 1.00 | 1.00 |

As already described, when receiving the command to be transmitted from the dimming control panel, the controller 3 subjects the instruction values for the respective light amounts included in the command to the color correction process. For example, the instruction values for the respective light amounts of the red light, the green light, and the blue light included in the command are represented by $L_{[R\text{-}req]}$, $L_{[G\text{-}req]}$, and $L_{[B\text{-}req]}$, respectively. Then, the instruction values (correction values) $L_{[R\text{-}sum]}$, $L_{[G\text{-}sum]}$, and $L_{[B\text{-}sum]}$ for the respective light amounts after the color correction process will be expressed in a matrix shown in following FORMULA 7.

$$\begin{pmatrix} L_{[R-sum]} \\ L_{[G-sum]} \\ L_{[B-sum]} \end{pmatrix} = \begin{pmatrix} L_{[R-Res]} & L_{[G-Res]} & L_{[B-Res]} \\ L_{[R-Ges]} & L_{[G-Ges]} & L_{[B-Ges]} \\ L_{[R-Bes]} & L_{[G-Bes]} & L_{[B-Bes]} \end{pmatrix} \begin{pmatrix} L_{[R-req]} \\ L_{[G-req]} \\ L_{[B-req]} \end{pmatrix} \quad \text{[FORMULA 7]}$$

In more detail, the controller 3 multiplies the instruction values (the first instruction value, the second instruction value, and the third instruction value) $L_{[R\text{-}req]}$, $L_{[G\text{-}req]}$, and $L_{[B\text{-}req]}$ for the respective light amounts of the red light, the green light, and the blue light given by the dimming control panel, with the correction coefficient (a 3 by 3 matrix shown on the right side of FORMULA 7), thereby executing the color correction process.

By doing the color correction process, the controller 3 calculates the correction values (the first correction value, the second correction value, and the third correction value) $L_{[R\text{-}sum]}$, $L_{[G\text{-}sum]}$, and $L_{[B\text{-}sum]}$ for the respective light amounts of the red light, the green light, and the blue light. Additionally, the controller 3 converts the instruction values $L_{[R\text{-}sum]}$, $L_{[G\text{-}sum]}$, and $L_{[B\text{-}sum]}$ of the light amounts resulting from the color correction process into the desired values (the first desired value, the second desired value, and the third desired value) $I_{RT}$, $I_{GT}$, and $I_{BT}$ of the drive currents for the light sources 1R, 1G, and 1B, respectively, and then provides the desired values $I_{RT}$, $I_{GT}$, and $I_{BT}$ to the drive circuits 20R, 20G, and 20B of the lighting circuits 2R, 2G, and 2B, respectively.

As described above, the controller 3 is configured to, to adjust the color of the illumination light to a color represented by a desired chromaticity point in the chromaticity diagram, determine the first desired value $I_{RT}$, the second desired value $I_{GT}$, and the third desired value $I_{BT}$ based on the correction coefficient. The correction coefficient is composed of coefficients for correcting the chromaticity point of the first color light, the chromaticity point of the second color light, and the chromaticity point of the third color light, to the first chromaticity point Res, the second chromaticity point Ges, and the third chromaticity point Bes, respectively.

In this regard, correcting the chromaticity point of the first color light to the first chromaticity point Res means obtaining the illumination light having the first chromaticity point Res. Similarly, correcting the chromaticity point of the second color light to the second chromaticity point Ges means obtaining the illumination light having the second chromaticity point Ges. Likewise, correcting the chromaticity point of the third color light to the third chromaticity point Bes means obtaining the illumination light having the third chromaticity point Bes.

Especially, the correction coefficient includes a combination of a ratio $L_{[R\text{-}Res]}$ of the first drive current corresponding to the first chromaticity point Res to the rated current of the first light source 1R, a ratio $L_{[G\text{-}Res]}$ of the second drive current corresponding to the first chromaticity point Res to the rated current of the second light source 1G, and a ratio $L_{[B\text{-}Res]}$ of the third drive current corresponding to the first chromaticity point Res to the rated current of the third light source 1B. This combination is a coefficient for obtaining the illumination light having the first chromaticity point Res.

Further, the correction coefficient includes a combination of a ratio $L_{[R\text{-}Ges]}$ of the first drive current corresponding to the second chromaticity point Ges to the rated current of the first light source 1R, a ratio $L_{[G\text{-}Ges]}$ of the second drive current corresponding to the second chromaticity point Ges to the rated current of the second light source 1G, and a ratio $L_{[B\text{-}Ges]}$ of the third drive current corresponding to the second chromaticity point Ges to the rated current of the third light source 1B. This combination is a coefficient for obtaining the illumination light having the second chromaticity point Ges.

Further, the correction coefficient includes a combination of a ratio $L_{[R\text{-}Bes]}$ of the first drive current corresponding to the third chromaticity point Bes to the rated current of the first light source 1R, a ratio $L_{[G\text{-}Bes]}$ of the second drive current corresponding to the third chromaticity point Bes to the rated current of the second light source 1G, and a ratio $L_{[B\text{-}Bes]}$ of the third drive current corresponding to the third chromaticity point Bes to the rated current of the third light source 1B. This combination is a coefficient for obtaining the illumination light having the third chromaticity point Bes.

The controller 3 is configured to perform the color correction process in response to reception of the first instruction value $L_{[R\text{-}req]}$ indicative of the desired light amount of the first light source 1R, the second instruction value $L_{[G\text{-}req]}$ indicative of the desired light amount of the second light source 1G, and the third instruction value $L_{[B\text{-}req]}$ indicative of the desired light amount of the third light source 1B for adjusting the color of the illumination light to the color represented by the desired chromaticity point. The controller 3 is configured to, in the color correction process, correct the first instruction value $L_{[R\text{-}req]}$, the second instruction value $L_{[G\text{-}req]}$, and the third instruction value $L_{[B\text{-}req]}$ to the first correction value $L_{[R\text{-}sum]}$, the second correction value $L_{[G\text{-}sum]}$, and the third correction value $L_{[B\text{-}sum]}$, based on the correction coefficient, respectively. The controller 3 is configured to determine the first desired value $I_{RT}$, the second desired value $I_{GT}$, and the third desired value $I_{BT}$, based on the first correction value $L_{[R\text{-}sum]}$, the second correction value $L_{[G\text{-}sum]}$, and the third correction value $L_{[B\text{-}sum]}$ obtained by the color correction process.

Note that, it is preferable that the controller 3 does not subject the light amount of white light (the light amount of the fourth light source 1W) given from the dimming control panel to the color correction process. The reason is that the individual difference in color in terms of the white light can be sufficiently reduced by a common technique such as color mixing and therefore this does not require any consideration on effects on the individual color difference in the color of the illumination light.

For example, the instruction values $L_{[R\text{-}req]}$, $L_{[G\text{-}req]}$, and $L_{[B\text{-}req]}$ for the respective light amounts of the red light, the green light, and the blue light are supposed to be 100%, 61.6%, and 9.4%, respectively, and the light amount (dimming level) of the illumination light is supposed to be 100%. The controller 3 reads out the correction coefficient corresponding to the dimming level of 100% from the data table shown in TABLE 1, and performs the color correction process by multiplying the correction coefficient with the instruction values (see FORMULA 8).

$$\begin{pmatrix} L_{[R-sum]} \\ L_{[G-sum]} \\ L_{[B-sum]} \end{pmatrix} = \begin{pmatrix} 95.00 & 3.00 & 2.00 \\ 5.00 & 90.00 & 5.00 \\ 0.00 & 7.00 & 93.00 \end{pmatrix} \begin{pmatrix} 100 \\ 61.6 \\ 9.4 \end{pmatrix} = \begin{pmatrix} 97.04 \\ 60.91 \\ 13.05 \end{pmatrix} \quad \text{[FORMULA 8]}$$

Further, the controller 3 converts the instruction values $L_{[R\text{-}sum]}$ of 97.04%, $L_{[G\text{-}sum]}$ of 60.91%, and $L_{[B\text{-}sum]}$ of 13.05% of the light amounts obtained by the color correction process, into the desired values $I_{RT}$, $I_{GT}$, and $I_{BT}$ of the drive currents, respectively. In a preferable example, the controller 3 multiplies the rated current values of the light sources 1R, 1G, and 1B by the instruction values $L_{[R\text{-}sum]}$, $L_{[G\text{-}sum]}$, and $L_{[B\text{-}sum]}$ for the light amounts, to convert them into the desired values $I_{RT}$, $I_{GT}$, and $I_{BT}$ of the drive currents, respectively.

Thus, the first to third drive circuits 20R, 20G, and 20B of the first to third lighting circuits 2R, 2G, and 2B control the first to third switching elements Q11, Q12, and Q13 to supply the first to third drive currents of the desired values $I_{RT}$, $I_{GT}$, and $I_{BT}$ to the light sources 1R, 1G, and 1B, respectively. Note that, the first to third drive circuits 20R, 20G, and 20B adjust the duty cycles of the first to third switching elements Q11, Q12, and Q13, thereby making the drive currents of the light sources 1R, 1G, and 1B equal to the desired values $I_{RT}$, $I_{GT}$, and $I_{BT}$, respectively. Alternatively, the first to third drive circuits 20R, 20G, and 20B adjust the ratios of the conduction periods to the rest periods of the first to third switching elements Q11, Q12, and Q13, thereby making the drive currents of the light sources 1R, 1G, and 1B equal to the desired values $I_{RT}$, $I_{GT}$, and $I_{BT}$, respectively. Note that, the aforementioned instruction values $L_{[R\text{-}req]}$, $L_{[G\text{-}req]}$, and $L_{[B\text{-}req]}$ for the respective light amounts of the red light, the green light, and the blue light are merely examples, and may be values corresponding to a desired chromaticity point in the region of the triangle β.

Accordingly, when the multiple lighting devices 10 (the lighting fixtures 100) have a function to execute the color correction process, differences between the chromaticity of the illumination light can be suppressed in a case where the dimming control panel provides the same instruction values to the multiple lighting devices 10 (the lighting fixtures 100). In other words, the multiple lighting devices 10 performing the color correction process have the same first chromaticity point Res of the red light, second chromaticity point Ges of the green light, and third chromaticity point Bes of the blue light included in the illumination light. As a result, the light amounts of the red light with the first chromaticity point Res, the green light with the second chromaticity point Ges, and the blue light with the third chromaticity point Bes are adjusted to the light amounts of the respective colors indicated by the instruction values from the dimming control panel. Consequently, differences between the colors of the illumination light of the lighting devices 10 can be suppressed. Further, the lighting device 10 of the present embodiment can adjust the color of the illumination light to a color represented by the chromaticity point inside the region indicated by the solid line β in FIG. 8, and therefore can expand the range of available colors relative to the conventional art.

As described above, the lighting device 10 of the present embodiment includes the first light source 1R, the second light source 1G, and the third light source 1B. Further, the lighting device 10 of the present embodiment includes: the first lighting circuit 2R for supplying the first drive current to the first light source 1R; the second lighting circuit 2G for supplying the second drive current to the second light source 1G; the third lighting circuit 2B for supplying the third drive current to the third light source 1B; and the controller 3. The controller 3 is configured to individually control the first lighting circuit 2R, the second lighting circuit 2G, and the third lighting circuit 2B to vary the first drive current, the second drive current, and the third drive current thereby adjusting the light amount of the first light source 1R, the light amount of the second light source 1G, and the light amount of the third light source 1B. The first light source 1R includes one or more first solid light emitting elements 10R for emitting the red light (the first color light). The second light source 1G includes one or more second solid light emitting elements 10G for emitting the green light (light different in color from the first color light). The third light source 1B includes one or more third solid light emitting elements 10B for emitting the blue light (light different in color from the first color light and the second color light). The first lighting circuit 2R is configured to vary the first drive current according to the first instruction value $L_{[R\text{-}sum]}$ provided from the controller 3. The second lighting circuit 2G is configured to vary the second drive current according to the second instruction value $L_{[G\text{-}sum]}$ provided from the controller 3. The third lighting circuit 2B is configured to vary the third drive current according to the third instruction value $L_{[B\text{-}sum]}$ provided from the controller 3. The controller 3 is configured to, to adjust the color of the illumination light composed of the red light, the green light, and the blue light, to the color represented by the desired chromaticity point in the chromaticity diagram, correct the chromaticity point of the red light to be emitted from the first light source 1R, to the first chromaticity point Res. Further, the controller 3 is configured to correct the chromaticity point of the green light to be emitted from the second light source 1G, to the second chromaticity point Ges, and also correct the chromaticity point of the blue light to be emitted from the third light source 1B, to the third chromaticity point Bes. Moreover, the controller 3 is configured to determine the first instruction value $L_{[R\text{-}sum]}$, the second instruction value $L_{[G\text{-}sum]}$, and the third instruction value $L_{[B\text{-}sum]}$, based on the correction coefficient used for correction to the first chromaticity point Res, the second chromaticity point Ges, and the third chromaticity point Bes. The first chromaticity point Res is defined as an intersection of the two straight lines 12RG and 12BR in the chromaticity diagram, the straight line 12RG being in contact with the approximate boundary surrounding the range of the individual difference in the chromaticity of the first light source 1R and the approximate boundary surrounding the range of the individual difference in the chromaticity of the second light source 1G, and the straight line 12BR being in contact with the approximate boundary surrounding the range of the individual difference in the chromaticity of the third light source 1B and the approximate boundary surrounding the range of the individual difference in the chromaticity of the first light source 1R. The second chromaticity point Ges is defined as an intersection of the two straight lines 12RG and 12GB in the chromaticity diagram, the straight line 12RG being in contact with the approximate boundary surrounding the range of the individual difference in the chromaticity of the first light source 1R and the approximate boundary surrounding the range of the individual difference in the chromaticity of the second light source 1G, and the straight line 12GB being in contact with the approximate boundary surrounding the range of the individual difference in the chromaticity of the second light source 1G and the approximate boundary surrounding the range of the individual difference in the chromaticity of the third light source 1B. The third chromaticity point Bes is defined as an intersection of the two straight lines 12GB and 12BR in the chromaticity diagram, the straight line 12GB being in contact with the approximate boundary surrounding the range of the individual difference in the chromaticity of the second light source 1G and the approximate boundary surrounding the range of the individual difference in the chromaticity of the third light source 1B, and the straight line 12BR being in contact with the approximate boundary surrounding the range of the individual difference in the chromaticity of the third light source 1B and the approximate boundary surrounding the range of the individual difference in the chromaticity of the first light source 1R.

Accordingly, the first chromaticity point Res of the red light, the second chromaticity point Ges of the green light, and the third chromaticity point Bes of the blue light included in the illumination light are common to the lighting devices 10 of the present embodiment. Then, the light amounts of the red light of the first chromaticity point Res, the green light of the second chromaticity point Ges, and the blue light of the third chromaticity point Bes are adjusted to the light amounts of the respective colors of the red light, the green light, and the blue light composing light with the desired color. Therefore, the lighting device 10 of the present embodiment is capable of expanding the range of available colors and suppressing an undesired effect due to an individual difference in color of illumination light. Note that, in the lighting device 10 of the present embodiment, the first color light is the red light, the second color light is the green light, and the third color light is the blue light. However, the illumination light may be a mixture of light other than the red light, the green light, and the blue light. Alternately, the lighting device 10 of the present embodiment can be modified to mix four or more types of light to produce the illumination light.

2. Aspects

As apparent from the above embodiment, the lighting device (10) of the first aspect according to the present disclosure includes a first light source (1R), a second light source (1G), a third light source (1B), a first lighting circuit (2R), a second lighting circuit (2G), a third lighting circuit (2B), and a controller (3). The first light source (1R) includes one or more first solid light emitting elements (10R) for emitting first color light and has a first range (11R) of an individual difference in chromaticity. The second light source (1G) includes one or more second solid light emitting elements (10G) for emitting second color light different in color from the first color light and has a second range (11G) of an individual difference in chromaticity. The third light source (1B) includes one or more third solid light emitting elements (10B) for emitting third color light different in color from the first color light and the second color light and has a third range (11B) of an individual difference in chromaticity. The first lighting circuit (2R) is configured to supply a first drive current according to a first desired value ($I_{RT}$) to the first light source (1R). The second lighting circuit (2G) is configured to supply a second drive current according to a second desired value ($I_{GT}$) to the second light source (1G). The third lighting circuit (2B) is configured to supply a third drive current according to a third desired value ($I_{BT}$) to the third light source (1B). The controller (3) is configured to provide the first desired value ($I_{RT}$), the second desired value ($I_{GT}$), and the third desired value ($I_{BT}$) to the first lighting circuit (2R), the second lighting circuit (2G), and the third lighting circuit (2B), respectively. The controller (3) is configured to, to adjust a color of illumination light to a color represented by a desired chromaticity point in a chromaticity diagram, determine the first desired value ($I_{RT}$), the second desired value ($I_{GT}$), and the third desired value ($I_{BT}$), based on a correction coefficient. The illumination light is composed of the first color light, the second color light, and the third color light. The correction coefficient is for correcting a chromaticity point of the first color light, a chromaticity point of the second color light, and a chromaticity point of the third color light to a first chromaticity point (Res), a second chromaticity point (Ges), and a third chromaticity point (Bes), respectively. The first chromaticity point (Res) is defined as an intersection of a straight line (12RG) in contact with the first range (11R) and the second range (11G) and another straight line (12BR) in contact with the first range (11R) and the third range (11B) in the chromaticity diagram. The second chromaticity point (Ges) is defined as an intersection of a straight line (12RG) in contact with the second range (11G) and the first range (11R) and another straight line (12GB) in contact with the second range (11G) and the third range (11B) in the chromaticity diagram. The third chromaticity point (Bes) is defined as an intersection of a straight line (12BR) in contact with the third range (11B) and the first range (11R) and another straight line (12GB) in contact with the third range (11B) and the second range (11G) in the chromaticity diagram.

The first aspect is capable of expanding the range of available colors and suppressing an undesired effect due to an individual difference in color of illumination light.

The lighting device (10) of the second aspect according to the present disclosure would be realized in combination with the first aspect. In the second aspect, the correction coefficient includes a combination of a ratio ($L_{[R\text{-}Res]}$) of the first drive current corresponding to the first chromaticity point (Res) to a rated current of the first light source (1R), a ratio ($L_{[G\text{-}Res]}$) of the second drive current corresponding to the first chromaticity point (Res) to a rated current of the second light source (1G), and a ratio ($L_{[B\text{-}Res]}$) of the third drive current corresponding to the first chromaticity point (Res) to a rated current of the third light source (1B). The correction coefficient includes a combination of a ratio ($L_{[R\text{-}Ges]}$) of the first drive current corresponding to the second chromaticity point (Ges) to a rated current of the first light source (1R), a ratio ($L_{[G\text{-}Ges]}$) of the second drive current corresponding to the second chromaticity point (Ges) to a rated current of the second light source (1G), and a ratio ($L_{[B\text{-}Ges]}$) of the third drive current corresponding to the second chromaticity point (Ges) to a rated current of the third light source (1B). The correction coefficient includes a combination of a ratio ($L_{[R\text{-}Bes]}$) of the first drive current corresponding to the third chromaticity point (Bes) to a rated current of the first light source (1R), a ratio ($L_{[G\text{-}Bes]}$) of the second drive current corresponding to the third chromaticity point (Bes) to a rated current of the second light source (1G), and a ratio ($L_{[B\text{-}Bes]}$) of the third drive current corresponding to the third chromaticity point (Bes) to a rated current of the third light source (1B).

In other words, the controller (3) is configured to adopt ratios of the first drive current, the second drive current, and the third drive current corresponding to the first chromaticity point (Res) to corresponding rated currents, as the correction coefficient. Further, the controller (3) is configured to adopt ratios of the first drive current, the second drive current, and the third drive current corresponding to the second chromaticity point (Ges) to corresponding rated currents, as the correction coefficient. Additionally, the controller (3) is configured to adopt ratios of the first drive current, the second drive current, and the third drive current corresponding to the third chromaticity point (Bes) to corresponding rated currents, as the correction coefficient.

The second aspect is capable of simplifying the color correction process to be performed by the controller (3).

The lighting device (10) of the third aspect according to the present disclosure would be realized in combination with the first or second aspect. In the third aspect, the controller (3) is configured to store the correction coefficient corresponding to any of chromaticity points included in a triangle (β) on the chromaticity diagram. The triangle (β) is formed by a segment (14RG) interconnecting the first chromaticity point (Res) and the second chromaticity point (Ges), another segment (14GB) interconnecting the second chromaticity point (Ges) and the third chromaticity point (Bes), and another segment (14BR) interconnecting the third chromaticity point (Bes) and the first chromaticity point (Res).

According to the third aspect, the range of adjustable chromaticity points can be expanded.

The lighting device (10) of the fourth aspect according to the present disclosure would be realized in combination with any one of the first to third aspects. In the fourth aspect, the first chromaticity point (Res) is defined as an intersection of a first straight line (12RG) and a second straight line (12BR). The second chromaticity point (Ges) is defined as an intersection of the first straight line (12RG) and a third straight line (12GB). The third chromaticity point (Bes) is defined as an intersection of the second straight line (12BR) and the third straight line (12GB). The first straight line (12RG) is defined as a straight line which is closest to the third range (11B) of straight lines touching the first range (11R) and the second range (11G) without crossing the first range (11R) and the second range (11G). The second straight line (12BR) is defined as a straight line which is closest to the second range (11G) of straight lines touching the first range (11R) and the third range (11B) without crossing the first range (11R) and the third range (11B). The third straight line (12GB) is defined as a straight line which is closest to the first range (11R) of straight lines touching the second range (11G) and the third range (11B) without crossing the second range (11G) and the third range (11B).

The lighting device (10) of the fifth aspect according to the present disclosure would be realized in combination with any one of the first to fourth aspects. In the fifth aspect, the controller (3) is configured to perform a color correction process in response to reception of a first instruction value ($L_{[R\text{-}req]}$) indicative of a desired light amount of the first light source (1R), a second instruction value ($L_{[G\text{-}req]}$) indicative of a desired light amount of the second light source (1G), and a third instruction value ($L_{[B\text{-}req]}$) indicative of a desired light amount of the third light source (1B) for adjusting the color of the illumination light to the color represented by the desired chromaticity point. The controller (3) is configured to, in the color correction process, correct the first instruction value ($L_{[R\text{-}req]}$), the second instruction value ($L_{[G\text{-}req]}$), and the third instruction value ($L_{[B\text{-}req]}$) to a first correction value ($L_{[R\text{-}sum]}$), a second correction value ($L_{[G\text{-}sum]}$), and a third correction value ($L_{[B\text{-}sum]}$), based on the correction coefficient, respectively. The controller (3) is configured to determine the first desired value ($I_{RT}$), the second desired value ($I_{GT}$), and the third desired value ($I_{BT}$), based on the first correction value ($L_{[R\text{-}sum]}$), the second correction value ($L_{[G\text{-}sum]}$), and the third correction value ($L_{[B\text{-}sum]}$) obtained by the color correction process.

The lighting fixture (100) of the sixth aspect according to the present disclosure includes: the lighting device (10) of any one of the first to fifth aspects, and a housing (the first housing 51 and the second housing 60) for bearing the lighting device (10).

The sixth aspect is capable of expanding the range of available colors and suppressing an undesired effect due to an individual difference in color of illumination light.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device capable of changing a color of illumination light, comprising:

a first light source which includes one or more first solid light emitting elements for emitting first color light and has a first range of an individual difference in chromaticity;

a second light source which includes one or more second solid light emitting elements for emitting second color light different in color from the first color light and has a second range of an individual difference in chromaticity;

a third light source which includes one or more third solid light emitting elements for emitting third color light different in color from the first color light and the second color light and has a third range of an individual difference in chromaticity;

a first lighting circuit configured to supply a first drive current according to a first desired value to the first light source;

a second lighting circuit configured to supply a second drive current according to a second desired value to the second light source;

a third lighting circuit configured to supply a third drive current according to a third desired value to the third light source; and a controller configured to provide the first desired value, the second desired value, and the third desired value to the first lighting circuit, the second lighting circuit, and the third lighting circuit, respectively, the controller being configured to, to adjust a color of illumination light composed of the first color light, the second color light, and the third color light, to a color represented by a desired chromaticity point in a chromaticity diagram, determine the first desired value, the second desired value, and the third desired value, based on a correction coefficient for correcting a chromaticity point of the first color light, a chromaticity point of the second color light, and a chromaticity point of the third color light to a first chromaticity point, a second chromaticity point, and a third chromaticity point, respectively, the first chromaticity point being defined as an intersection of a straight line in contact with the first range and the second range and another straight line in contact with the first range and the third range in the chromaticity diagram, the second chromaticity point being defined as an intersection of a straight line in contact with the second range and the first range and another straight line in contact with the second range and the third range in the chromaticity diagram, and the third chromaticity point being defined as an intersection of a straight line in contact with the third range and the first range and another straight line in contact with the third range and the second range in the chromaticity diagram, the correction coefficient including:

a combination of a ratio of the first drive current corresponding to the first chromaticity point to a rated current of the first light source, a ratio of the second drive current corresponding to the first chromaticity point to a rated current of the second light source, and a ratio of the third drive current corresponding to the first chromaticity point to a rated current of the third light source;

a combination of a ratio of the first drive current corresponding to the second chromaticity point to a rated current of the first light source, a ratio of the second drive current corresponding to the second chromaticity point to a rated current of the second light source, and a ratio of the third drive current corresponding to the second chromaticity point to a rated current of the third light source; and a combination of a ratio of the first drive current corresponding to the third chromaticity point to a rated current of the first light source, a ratio of the second drive current corresponding to the third chromaticity point to a rated current of the second light source, and a ratio of the third drive current corresponding to the third chromaticity point to a rated current of the third light source, and the controller being configured to store the correction coefficient corresponding to any of chromaticity points included in a triangle on the chromaticity diagram formed by a segment interconnecting the first chromaticity point and the second chromaticity point, another segment interconnecting the second chromaticity point and the third chromaticity point, and another segment interconnecting the third chromaticity point and the first chromaticity point.

2. The lighting device of claim 1, wherein:

the controller is configured to perform a color correction process in response to reception of a first instruction value indicative of a desired light amount of the first light source, a second instruction value indicative of a desired light amount of the second light source, and a third instruction value indicative of a desired light amount of the third light source for adjusting the color of the illumination light to the color represented by the desired chromaticity point;

the controller is configured to, in the color correction process, correct the first instruction value, the second instruction value, and the third instruction value to a first correction value, a second correction value, and a third correction value, based on the correction coefficient, respectively; and the controller is configured to determine the first desired value, the second desired value, and the third desired value, based on the first correction value, the second correction value, and the third correction value obtained by the color correction process.

3. A lighting fixture, comprising:

the lighting device of claim 1, and a housing for bearing the lighting device.

4. A lighting device capable of changing a color of illumination light comprising:

a first light source which includes one or more first solid light emitting elements for emitting first color light and has a first range of an individual difference in chromaticity;

a second light source which includes one or more second solid light emitting elements for emitting second color light different in color from the first color light and has a second range of an individual difference in chromaticity;

a third light source which includes one or more third solid light emitting elements for emitting third color light different in color from the first color light and the second color light and has a third range of an individual difference in chromaticity;

a first lighting circuit configured to supply a first drive current according to a first desired value to the first light source;

a second lighting circuit configured to supply a second drive current according to a second desired value to the second light source;

a third lighting circuit configured to supply a third drive current according to a third desired value to the third light source; and a controller configured to provide the first desired value, the second desired value, and the third desired value to the first lighting circuit, the second lighting circuit, and the third lighting circuit, respectively, the controller being configured to, to adjust a color of illumination light composed of the first color light, the second color light, and the third color light, to a color represented by a desired chromaticity point in a chromaticity diagram, determine the first desired value, the second desired value, and the third desired value, based on a correction coefficient for correcting a chromaticity point of the first color light, a chromaticity point of the second color light, and a chromaticity point of the third color light to a first chromaticity point, a second chromaticity point, and a third chromaticity point, respectively, the first chromaticity point being defined as an intersection of a straight line in contact with the first range and the second range and another straight line in contact with the first range and the third range in the chromaticity diagram, the second chromaticity point being defined as an intersection of a straight line in contact with the second range and the first range and another straight line in contact with the second range and the third range in the chromaticity diagram, and the third chromaticity point being defined as an intersection of a straight line in contact with the third range and the first range and another straight line in contact with the third range and the second range in the chromaticity diagram, the first chromaticity point being defined as an intersection of a first straight line and a second straight line;

the second chromaticity point being defined as an intersection of the first straight line and a third straight line;

the third chromaticity point being defined as an intersection of the second straight line and the third straight line;

the first straight line being defined as a straight line which is closest to the third range of straight lines touching the first range and the second range without crossing the first range and the second range;

the second straight line being defined as a straight line which is closest to the second range of straight lines touching the first range and the third range without crossing the first range and the third range; and the third straight line being defined as a straight line which is closest to the first range of straight lines touching the second range and the third range without crossing the second range and the third range.

5. The lighting device of claim 4, wherein:

the controller is configured to perform a color correction process in response to reception of a first instruction value indicative of a desired light amount of the first light source, a second instruction value indicative of a desired light amount of the second light source, and a third instruction value indicative of a desired light amount of the third light source for adjusting the color of the illumination light to the color represented by the desired chromaticity point;

the controller is configured to, in the color correction process, correct the first instruction value, the second instruction value, and the third instruction value to a first correction value, a second correction value, and a third correction value, based on the correction coefficient, respectively; and the controller is configured to determine the first desired value, the second desired value, and the third desired value, based on the first correction value, the second correction value, and the third correction value obtained by the color correction process.

6. A lighting fixture, comprising:

the lighting device of claim 4, and a housing for bearing the lighting device.

* * * * *